United States Patent [19]

Sedam

[11] Patent Number: 4,911,331

[45] Date of Patent: Mar. 27, 1990

[54] BEVERAGE QUALITY SECURITY APPARATUS FOR POST-MIX BEVERAGE DISPENSER

[75] Inventor: Jason K. Sedam, Dunwoody, Ga.

[73] Assignee: The Coca-Cola Company, Atlanta, Ga.

[21] Appl. No.: 671,962

[22] Filed: Nov. 16, 1984

[51] Int. Cl.[4] ..... B67D 5/60

[52] U.S. Cl. ..... 222/132; 222/182; 312/223

[58] Field of Search ..... 222/132, 131, 129, 182, 222/185, 144.5, 145, 135, 129.1, 173, 180, 181, 325; 312/223, 222, 271; 248/313, 316.7, 201, 224.3; 221/129

[56] References Cited

U.S. PATENT DOCUMENTS

| | | | |
|---|---|---|---|
| D. 269,948 | 8/1983 | Janssen | D9/375 |
| 1,570,052 | 1/1926 | Erwin | 248/313 |
| 3,723,851 | 3/1973 | Johnson et al. | 222/132 |
| 3,853,366 | 12/1974 | Kesling et al. | 313/223 |
| 3,940,016 | 2/1976 | Krakauer | 221/129 |
| 4,003,613 | 1/1977 | Dakley | 312/223 |
| 4,164,306 | 8/1979 | Perrin | 222/181 |
| 4,394,938 | 7/1983 | Frassanito | 222/325 |
| 4,493,441 | 1/1985 | Sedam et al. | 222/129.1 |

*Primary Examiner*—Joseph J. Rolla
*Assistant Examiner*—Kenneth Noland
*Attorney, Agent, or Firm*—Birch, Stewart, Kolasch & Birch

[57] ABSTRACT

A beverage quality security apparatus for a post-mix beverage dispenser including a concentrate supply compartment for supporting concentrate containers in dispensing positions, an access door to the compartment and protrusions on the inside of the access door which fit into recesses in the containers when the door is closed. The door also must actuate a limit switch when the door is closed before the dispenser can be electrically energized to dispense a selected beverage.

4 Claims, 2 Drawing Sheets

BEVERAGE QUALITY SECURITY APPARATUS FOR POST-MIX BEVERAGE DISPENSER

BACKGROUND OF THE INVENTION

The present invention relates to a beverage quality security apparatus for a post-mix beverage dispenser. More specifically, the present invention relates to an arrangement of components in a post-mix beverage dispenser which precludes the use of syrup or concentrate containers therein which are not specifically deigned for that dispenser to assure proper dispenser operation and uniform beverage quality.

In designing post-mix beverage dispensers which produce high quality beverages, a great deal of thought goes into the selection of all primary components thereof which conjointly, consistently produce high quality beverages. For example, the type of syrup package, carbonator and CO2 supply devices utilized in combination may be critical to the proper operation of the dispenser. In the highly competitive soft drink market, many parties will attempt to sell substitute components of inferior quality and functionality for use in dispensers. For example, much cheaper, but unsuitable, syrup containers may be sold to dispenser owners which will not function up to required standards for the dispenser, resulting in the production of inferior quality beverages. This situation, of curse, is not in the best interests of the consuming public.

An exemplary post-mix beverage dispenser in which all components, such as the syrup supply containers, are carefully selected to operate in concert to produce high quality, post-mix beverages, is described in published European Patent Application No. 0 027 880 to applicant Bosch-Siemens Hauggerate GmbH, published May 6, 1981. Substitution of any of the primary components of this dispensing system, and especially the syrup containers, may be detrimental to the operation of the system.

Therefore, a need in the art exist for means for precluding the substitution of inferior components such as incompatible syrup containers, into high quality, post-mix beverage dispenser systems.

SUMMARY OF THE INVENTION

Accordingly, it is a primary object of the present invention to provide a system for precluding the substitution of incompatible key components into post-mix beverage dispensers.

More specifically, it is an object of the present invention to preclude the substitution of incompatible and inferior syrup containers into post-mix beverage dispensers which have been designed for use with specific preferred embodiments of syrup containers.

The objects of the present invention are fulfilled by providing a beverage quality security apparatus for a post mix beverage dispenser comprising a dispenser cabinet having an access door to a concentrate supply compartment, movable between opened and closed positions, the door having at lest one male protrusion thereon extending into the concentrate supply compartment when the door is closed, the protrusion having a predetermined shape; and at least one concentrate container for use in the supply compartment in a dispensing position and having a recess means therein of a complimentary shape to the at least one protrusion for receiving that protrusion when the door is closed. Consequently, a substitute container without an appropriate recess therein, conformally shaped to the male protrusion on the access door, would engage the male protrusions and preclude the door from closing.

An electrical interlock is also provided between the access door and the electrical circuit for energizing solenoid-actuated dispenser valves in each of the syrup containers. This electrical interlock means includes a limit switch positioned adjacent to a point on the dispenser cabinet where the door engages when fully closed. The limit switch is normally open, but closes when the door engages a button on the same when the door is in a fully closed position. The limit switch is in series circuit with a selector switch which initiates operation of a solenoid valve associated with a particular syrup or concentrate flavor selected by the switch. Accordingly, unless the door is fully closed, closing the limit switch, actuation of the solenoid-actuated valves is precluded by the door limit switch.

The syrup or concentrate container of the present invention is further provided with a slot in the leading sidewall of the syrup container, that is the sidewall which enters the syrup compartment first as a syrup container is introduced into the compartment. This slot is so shaped and oriented that it will receive a protruding fin extending from the back wall of the syrup compartment into the same when the container is properly inserted into its dispensing position. Accordingly, a container without such a slot for receiving the protruding fin in the syrup compartment may not be utilized in the beverage dispenser because it cannot be indexed into the proper dispensing position.

BRIEF DESCRIPTION OF THE DRAWINGS

The objects of the present invention and the attendant advantages thereof will become more readily apparent by reference to the following drawings, like reference numerals representing like parts and wherein.

DETAILED DESCRIPTION OF THE PREFERRED EMBODIMENTS

Figure 1:
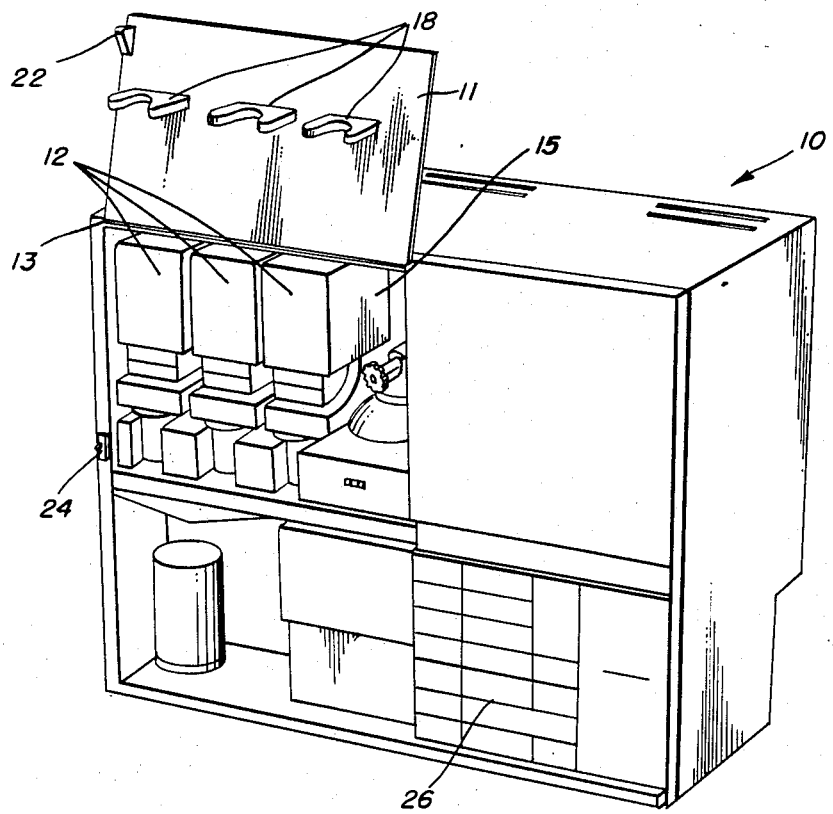
FIG. 1 is a front and top perspective view of a post-mix beverage dispenser cabinet including the beverage quality security apparatus of the present invention.

Referring to FIG. 1, there is illustrated a post-mix beverage dispenser cabinet 10 of an exemplary type to be utilized with the beverage quality security apparatus of the present invention. As illustrated, cabinet 10 is provided with an access door 11, shown in a fully opened position, which pivots about hinges 13 on the top front edge of the beverage dispenser cabinet. The access door 11 provides access to and covers the syrup compartment 15, in which a plurality of gravity flow syrup containers 12 are disposed in their respective dispensing positions. The beverage dispenser of FIG. 1 may be of the type disclosed in published EPO Patent Application No. 0 027 880, published May 6, 1981 to applicant Bosch-Siemens Hausgerate GmbH. The beverage dispenser cabinet 10 of FIG. 10 also has disposed therein a selecter switch array 26 for selecting the type of post-mix beverage to be dispensed from a respective one of the syrup or concentrate containers 12.

Figure 2:
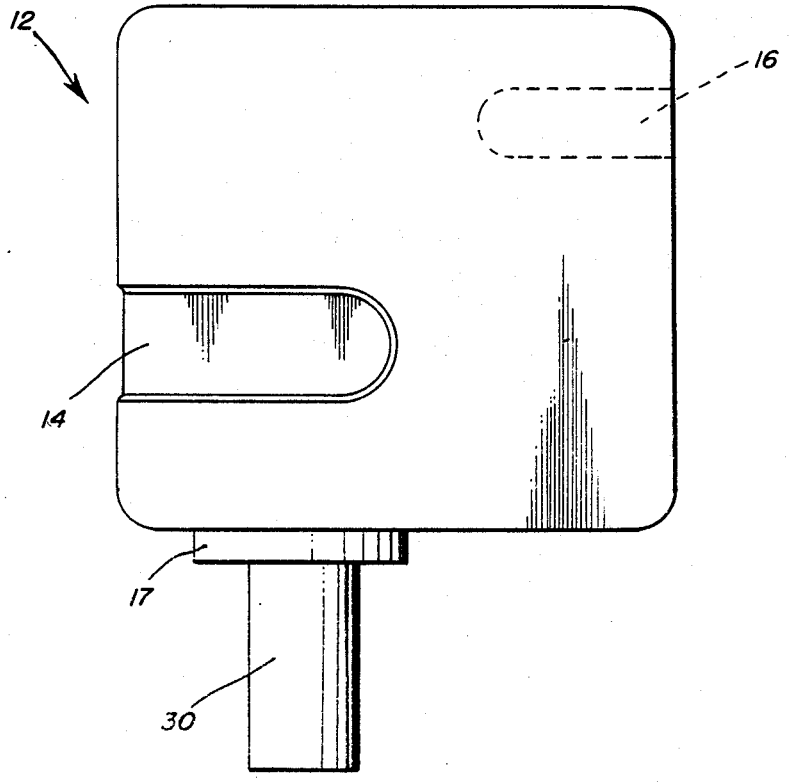
FIG. 2 is a side elevational view of the syrup or concentrate container of the present invention used in the concentrate supply compartment of the dispenser cabinet of FIG. 1.

Referring to FIG. 2, there is illustrated a syrup or concentrate container 12 utilized within the beverage dispense cabinet 10 of FIG. 1. This container 12 includes a U-shaped slot 14 for accommodating the fingers of a dispenser operator to facilitate the secure gripping of the container while inserting it into the syrup compartment 15 of the cabinet 10. This U-shaped slot 14 wraps around the container on three adjacent sidewalls thereof. The container described thus far is more fully illustrated in U.S. Pat. No. Des. 269,948, issued Aug. 2, 1983 to Jansson. The Jansson Patent is incorporated herein by reference.

The improved Container 12 of the present invention is also provided with a slot 16 for receiving a protruding fin 20, to be described further hereinafter with reference to FIG. 3. Slot 16 is provided on the leading edge or sidewall of the container 12, as it would be inserted into the syrup compartment 15 of FIG. 1 into its dispensing position.

Figure 3:
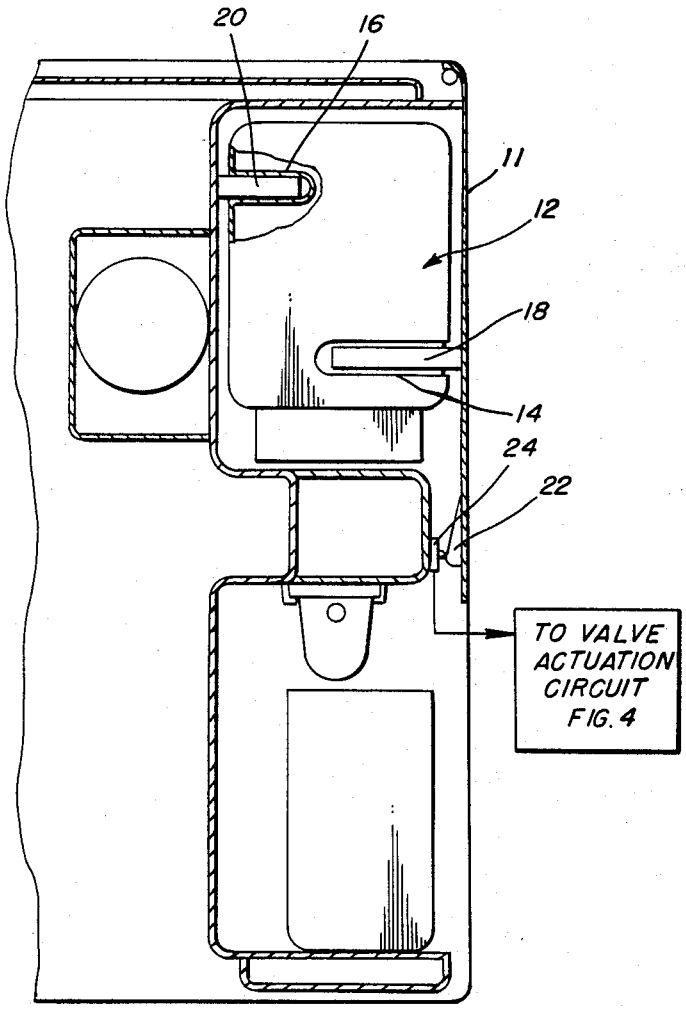
FIG. 3 is a side elevational view, partially in section, of the cabinet of FIG. 1 illustrating how the containers of FIG. 2 are disposed therein.

FIG. 3 shows how one of the syrup containers 12 is disposed when in the proper dispensing position in the syrup compartment 15 of cabinet 10. As illustrated, the protruding fin 20 extends from the rear wall of the syrup compartment 15 into slot 16, to index the container 12 in the proper dispensing position. Also as illustrated in FIG. 3, the protrusions 18 on the inner surface of access door 11 extend into the U-shaped recess 14 in the container 12. As better illustrated in FIG. 1, these protrusions 18 are yoke-shaped. That is, they have a complementary shape to the U-shape 14 of the container 12 so that when door 11 is fully closed, the yoke-shaped protrusions mate with the U-shaped slots 14 in containers 12. Also illustrated in FIG. 3 is a door limit switch 24, a microswitch of a well-known variety, which is normally open until the actuator button thereon is depressed, to complete an electrical circuit. Door 11 is provided with an actuator member 22 thereon which, when the door 11 is fully closed, presses against the actuator button of the door limit switch 24 to complete a circuit within the dispenser valve actuator circuit of FIG. 4, to be described hereinafter.

Figure 4:
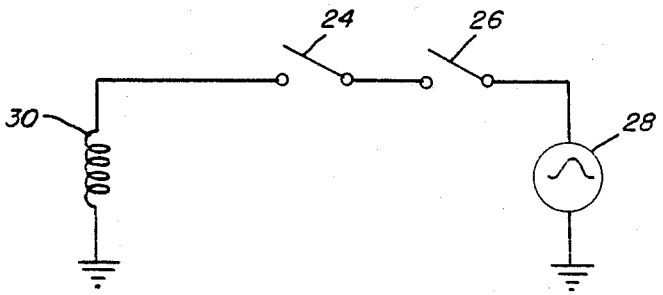
FIG. 4 is a circuit diagram of the syrup valve actuating circuit of the dispenser illustrating how electrical lock-out is provided by a door limit switch.

Referring to FIG. 4, there is illustrated an electrical valve actuation circuit, which is typical for each of the respective syrup containers 12 and the associated solenoid actuated valve 30 disposed in fluid communication with the exit openings 17 thereof. As shown in FIG. 4, the appropriate one of the selector switches 26, which actuates the solenoid valve for a particular type of flavor concentrate, is in series circuit with door limit switch 24 of FIG. 3 and a power supply 28, as well as the associate solenoid actuated valve 30. Accordingly, it can be readily seen that an electrical interlock is provided such that if door limit switch 24 is not closed, the actuation of a selector switch 26 cannot cause the energization of a solenoid actuated valve. Therefore, unless the door 11 is fully closed, causing actuator member 22 to close door limit switch 24, beverage cannot be dispensed. Of course, door 11 cannot be fully closed if the syrup container 12 of the present invention, including the U-shaped slot 14 and the slot 16 on the leading edge thereof, are provided for receiving the yoke-shaped protrusions 18 and fin 20, respectively.

It should be understood that the apparatus described hereinbefore may be modified, as would occur to one of ordinary skill in the art, without departing from the spirit and scope of the present invention.

What is claimed is:

1. A beverage quality security apparatus for a post-mix beverage dispenser comprising:

(a) a dispenser cabinet having an access door to a concentrate supply compartment movable between opened and closed positions, said door having at least one protrusion extending into said concentrate supply compartment when said door is closed, said protrusion having a predetermined shape;

(b) at least one concentrate container for use in said compartment in a dispensing position and having a recess means therein of a complementary shape to said at least one protrusion for receiving said protrusion when said door is closed;

(c) electrically-operated valve means coupled to said concentrate container for dispensing concentrate therefrom when energized;

(d) selector switch means for energizing said valve means; and (e) door limit switch means in circuit with said selector switch means for permitting said selector switch means to energize said valve means when said door is fully closed but precluding said switch means from energizing said valve means when said door is not fully closed;

whereby a substitute container without said recess means would engage said at least one protrusion and preclude said door from closing.

2. The apparatus of claim 1, further comprising:

(a) fin means extending from the rear of said concentrate supply compartment into the region occupied by said container when in said dispensing position; and (b) slot means in said container for receiving said fin means and indexing said container in said dispensing position;

whereby a container without said slot means cannot occupy said dispensing position.

3. The apparatus of claim 1, wherein said recess means is a U-shaped slot formed in three adjacent sidewalls of said container for accommodating the fingers of an operator to facilitate secure gripping of said container.

4. The apparatus of claim 3, wherein said protrusion is yoke-shaped for mating with said U-shaped slot.

* * * * *